US008505168B1

(12) United States Patent
Chapman

(10) Patent No.: US 8,505,168 B1
(45) Date of Patent: Aug. 13, 2013

(54) NON-INVASIVE DOOR HINGE MOUNTED SUPPORT

(76) Inventor: Adam C. Chapman, Chicago, IL (US)

( * ) Notice: Subject to any disclaimer, the term of this patent is extended or adjusted under 35 U.S.C. 154(b) by 592 days.

(21) Appl. No.: 12/320,749

(22) Filed: Feb. 3, 2009

(51) Int. Cl.
*E05D 5/00* (2006.01)

(52) U.S. Cl.
USPC ..... 16/382; 49/383; 49/384; 49/381; 160/40; 16/223

(58) Field of Classification Search
USPC ..... 248/200, 202.1, 213.1, 220.1, 274.1, 248/289.11; 16/223, 382; 49/383, 384, 381; 160/40
See application file for complete search history.

(56) References Cited

U.S. PATENT DOCUMENTS

| | | | | | |
|---|---|---|---|---|---|
| 1,195,098 | A * | 8/1916 | Saino | 49/383 |
| 1,893,450 | A * | 1/1933 | Shively | 49/383 |
| 1,929,494 | A * | 10/1933 | Horlick, Jr | 49/404 |
| 3,567,261 | A * | 3/1971 | Akczinzki | 3/106 |
| 3,911,622 | A * | 10/1975 | Prohaska | 49/383 |
| 4,344,253 | A * | 8/1982 | Stiles | 49/383 |
| 5,193,697 | A * | 3/1993 | Lubczyk et al. | 211/183 |
| 5,483,771 | A * | 1/1996 | Herbst | 49/504 |
| 5,516,067 | A * | 5/1996 | Schiele | 248/220.21 |
| 5,529,273 | A * | 6/1996 | Benthin | 248/254 |
| 5,551,980 | A * | 9/1996 | Turnbo | 118/500 |
| 5,765,311 | A * | 6/1998 | Kapler | 49/383 |
| 5,810,317 | A * | 9/1998 | Macchi | 248/475.1 |
| 6,142,320 | A * | 11/2000 | DeLorean et al. | 211/70.6 |
| 6,434,888 | B1 * | 8/2002 | Shaw et al. | 49/383 |
| 7,921,603 | B2 * | 4/2011 | Darnell | 49/504 |
| 2001/0029703 | A1 * | 10/2001 | Nakamoto et al. | 49/503 |
| 2006/0048466 | A1 * | 3/2006 | Darnell | 52/204.1 |
| 2007/0245525 | A1 * | 10/2007 | Hoffman | 16/367 |
| 2007/0284492 | A1 * | 12/2007 | Oh | 248/220.1 |

* cited by examiner

*Primary Examiner* — Terrell McKinnon
*Assistant Examiner* — Michael McDuffie
(74) *Attorney, Agent, or Firm* — Dillis V. Allen, Esq.

(57) ABSTRACT

A non-invasive door bracket assembly that does no damage to the door or the door jam. It utilizes the door jam hinge screws to support the bracket assembly reducing parts and eliminating additional holes in the door and jam, while providing higher load support. This assembly can support a variety of door products but principally a child proof door jam cover.

9 Claims, 6 Drawing Sheets

Fig. 7
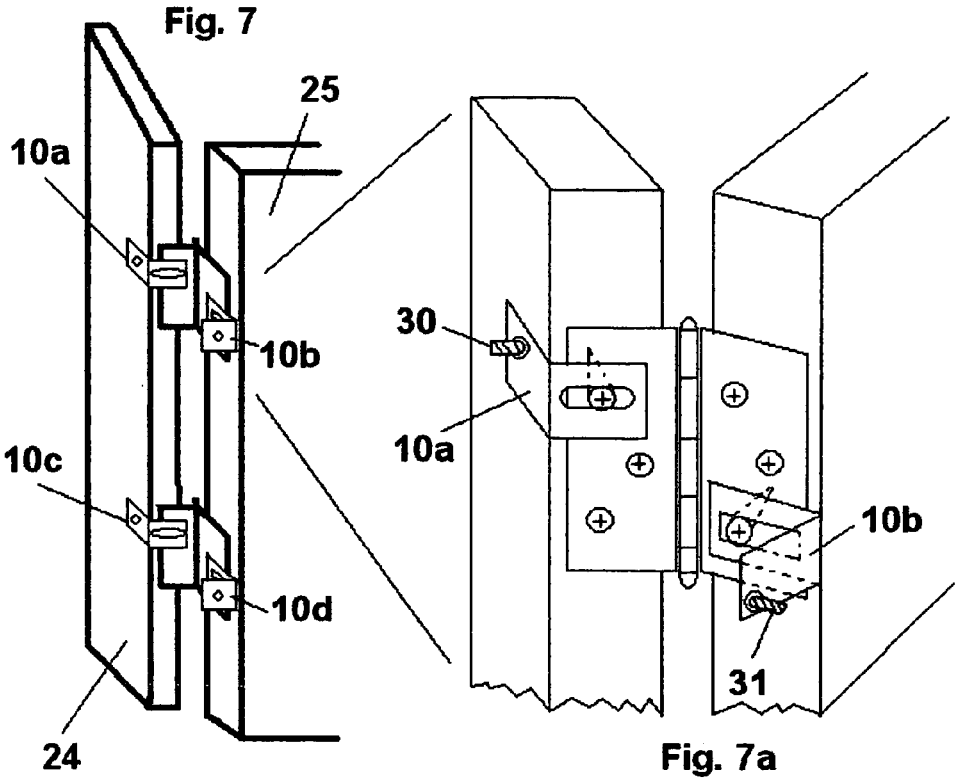
Fig. 7a
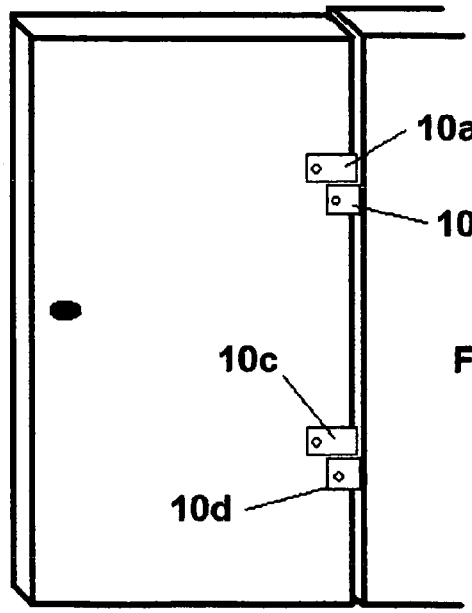
Fig. 8

NON-INVASIVE DOOR HINGE MOUNTED SUPPORT

BACKGROUND OF THE INVENTION

Child proof door jam covers have been provided in the past for preventing pinching the child's fingers in door jams as the doors open and close. Many village, city and county ordinances in communities in the United States require such door jam covers to ensure the safety of our children. Unfortunately, the existing door jam products require drilling and screwing into existing doors and associated jams. Landlords have lease provisions that prohibit damage to the leased property by the tenant and thus prevent the protection of the tenants' children as well as their guests' children.

Hinge pin brackets have been provided in the past, such as shown in the Buckelew, U.S. Pat. No. 6,658,696.

It is a primary object of the present invention to provide a door mounted bracket system that is non-invasive and uses existing hardware as its support on the door and jam.

SUMMARY OF THE PRESENT INVENTION

According to the present invention, a door hinge mounted bracket assembly is provided that is not destructive to the door or jam, increases load bearing values; and is simple to install with minimum tools.

Toward these ends, a plurality of generally "L" shaped brackets is provided that complement and mate with each other as the door closes into the jam. These mating brackets are preferably identical with one mounted on the jam hinge plate and the other mounted on the door hinge plate forming a spaced 90 degree portion with the door open and a mating 0 degree portion when the doors are closed.

Each of the "L" shaped brackets has a first leg that attaches to one of the hinge plates using the same screws that attach the hinge plate to the door and the door jam reducing part costs and increasing the load capacity of the present bracket because the hinge assembly has a load capacity of over 200 lbs. greater than the load capacity of a similar bracket screwed directly into a wooden door and jam.

One important application for the present bracket assemblies is the door jam covers mandated by many municipal or other ordinances to protect children appendages (hands and feet) from being bruised and broken in opening and closing door jams.

The present bracket system facilitates the mounting of door jam cover products over condo, apartment and other door jams to minimize injury to principally children, but also any human appendage.

BRIEF DESCRIPTION OF THE DRAWINGS

FIGS. 5 and 6 are cross sections through the door brackets illustrated in FIGS. 1 to 4 shown installed to a door frame hinge and a corresponding door hinge with the door closed in. FIG. 5, and opened in FIG. 6;

FIG. 7 is a perspective view of a door and adjacent wall with the present door bracket assemblies mounted on the respective hinges;

FIG. 7*a* is an enlarged view of the upper hinge in FIG. 7;

FIG. 8 corresponds with FIG. 7 except the door is shown closed;

DETAILED DESCRIPTION OF THE PREFERRED EMBODIMENTS

Figure 1:
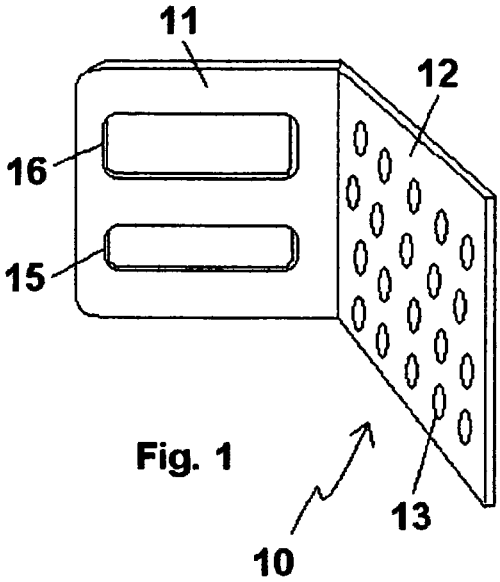
FIG. 1 is a perspective view of a non-invasive door bracket according to the present invention.
Figure 2:
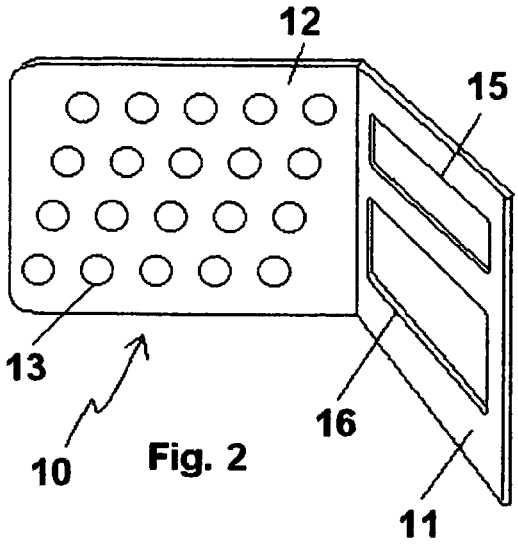
FIG. 2 is a perspective view of the non-invasive door bracket depicted in FIG. 1 rotated 180 degrees.
Figure 3:
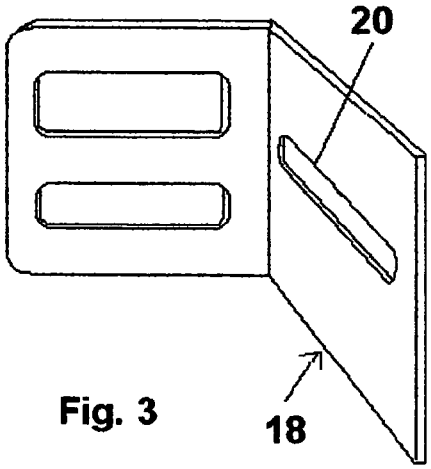
FIG. 3 is a perspective view of a somewhat modified embodiment of the present non-invasive door bracket.
Figure 4:
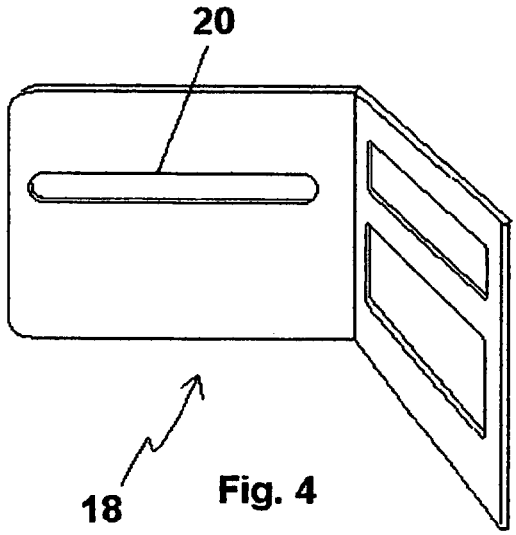
FIG. 4 is a perspective view of the non-invasive door bracket illustrated in FIG. 3 rotated 180 degrees.
Figure 5:
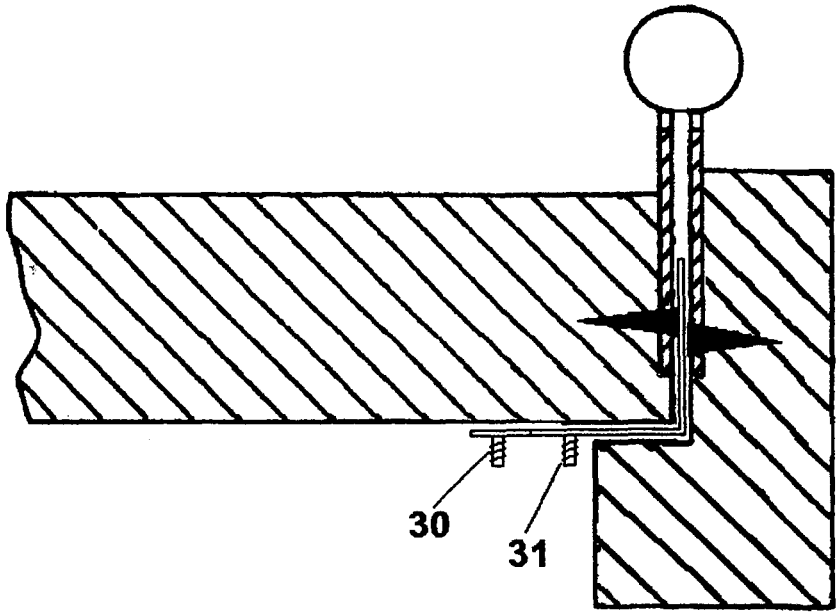
Figure 6:
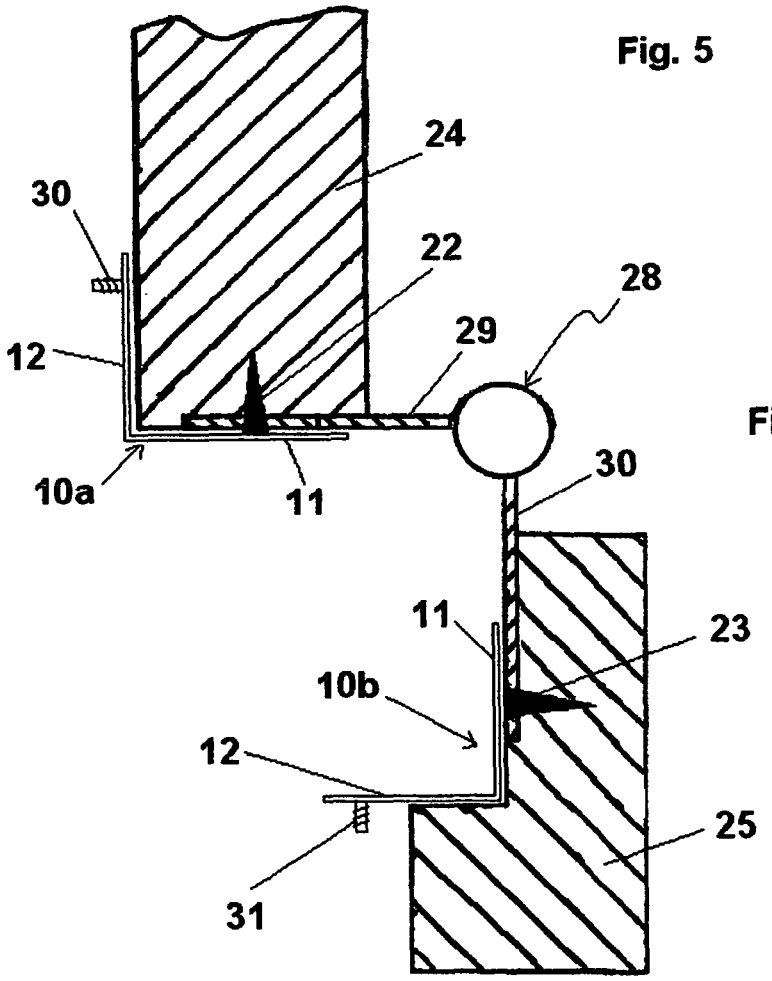

Referring to the drawings and initially only FIGS. 1 and 2, a bracket sub-assembly 10 of the present non-invasive door bracket assembly is illustrated and is seen to be L-shaped (90 degrees) in configuration including a first leg portion 11 adapted to be mounted to the door hinge and a second leg portion 12 having a plurality of rows of apertures 13 for receiving support fasteners. Leg 11 has two horizontal slots 15 and 16 with slot 15 being sized to accept residential-sized hinge screws and slot 17 being adapted to accommodate larger commercial door hinge screws. Bracket 18 in FIGS. 3 and 4 is identical to bracket 10 in FIGS. 1 and 2 except that an elongated slot 20 replaces the rows of holes 13, but is also adapted to receive and support a fastener in a plurality of horizontal positions. Slots 15 and 16 in the FIG. 1 embodiment are also elongated to accommodate non-standard hinge screw hole positions. Two brackets 10 are illustrated in FIGS. 5 and 6 mounted on a door hinge. Screws 22 and 23 are screws removed from the hinge and then replaced in the brackets 10 to hold the brackets in position against a jam frame or wall 24 and adjacent door 25 shown respectively in the closed and opened positions in FIGS. 5 and 6. The hinge itself in these views is indicated by a pivot assembly 28 and hinge plates 29 and 30. Note the fasteners 30 and 31 mounted in the slot in the legs 12. FIGS. 7 and 7*a* are perspective views with the door opened in the assemblies shown in FIGS. 5 and 6, and note in FIG. 7, as well as FIG. 7*a*, that bracket assembly 10*a* is mounted above bracket assembly 10*b* slightly so that they do not interfere with the proper closure of the door. FIG. 8 illustrates the brackets 10*a*, 10*b*, 10*c*, and 10*d* in the door closed positions.

The fasteners 30 and 31 are adapted, according to the present invention, to support a wide variety of implements on the door or near the door jam. However, one of the principal applications for applicant's unique anti-invasive bracket is to support safety shields, primarily child safety shields, across the jam in both the opened and closed positions of the door to prevent injury to the child's appendages.

Figure 9:
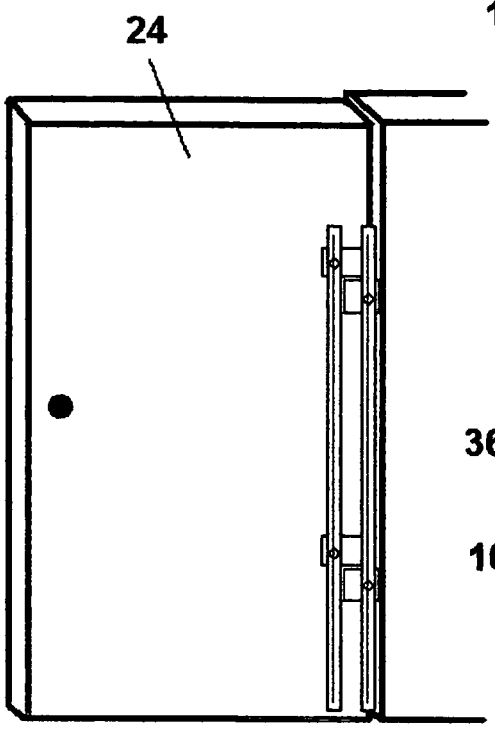
FIGS. 9 to 12 respectively show the door brackets illustrated in FIGS. 7 to 8 with vertical mounted brackets attached and with door jam safety panels shown in FIGS. 11 and 12.
Figure 10:
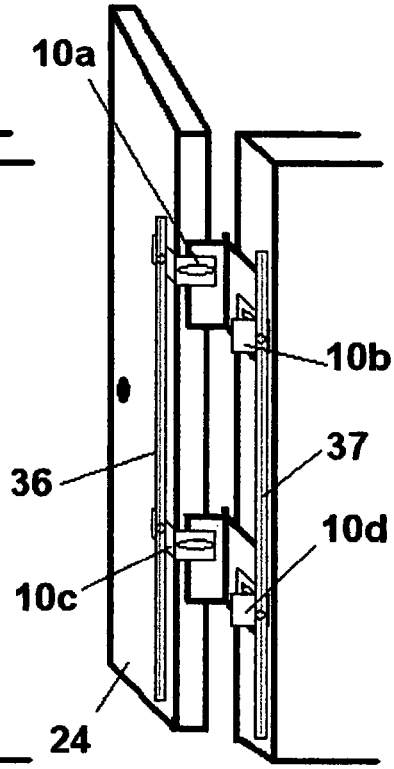
Figure 11:
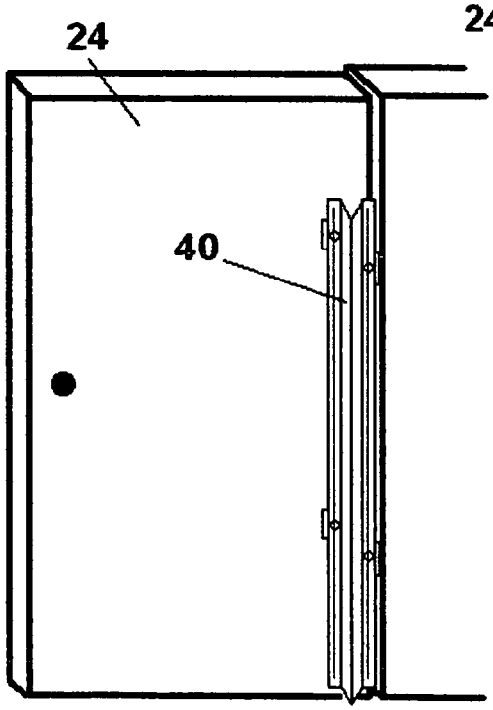
Figure 12:
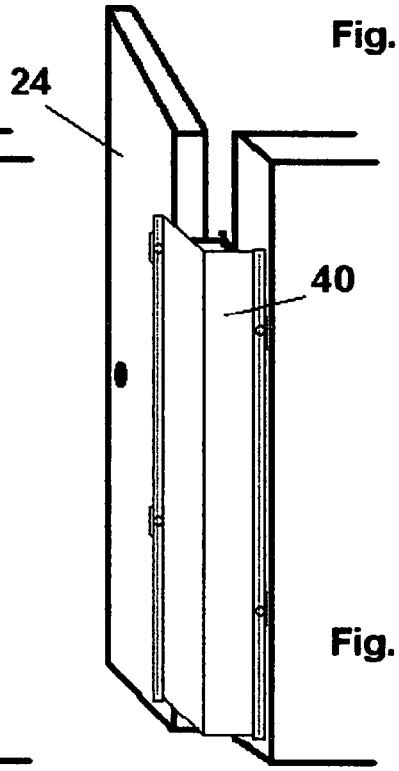
Figure 13:
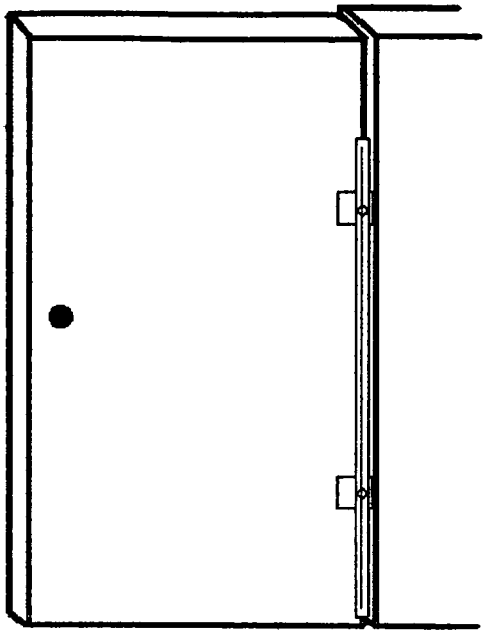
FIGS. 13 to 16 are similar to FIGS. 9 to 12 except that they illustrate the mounting brackets and vertical support attached thereto only on the wall mounted hinges.
Figure 14:
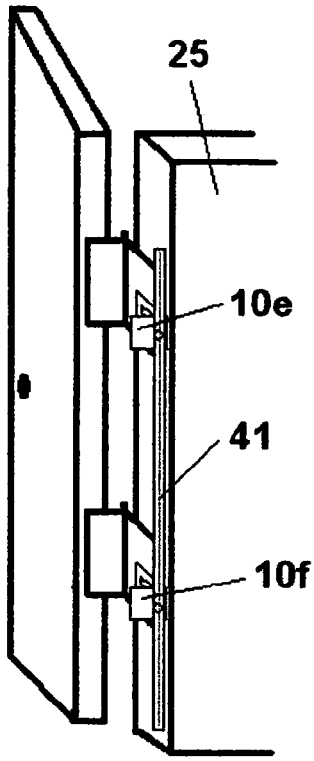
Figure 15:
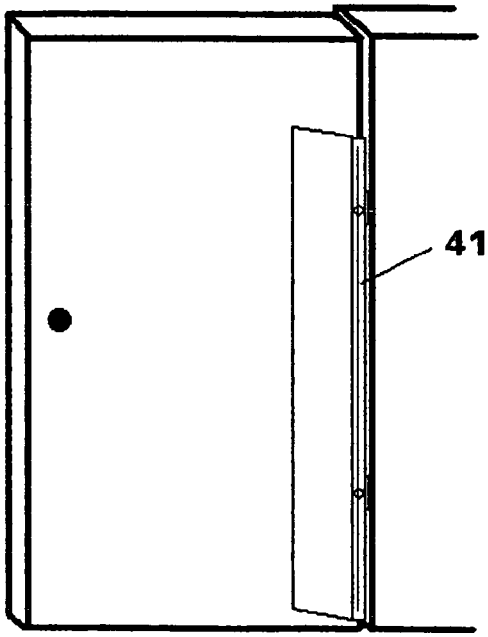
Figure 16:
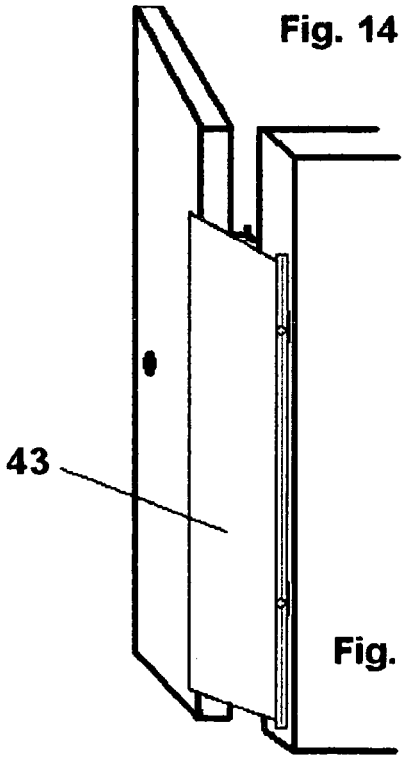
Figure 17:
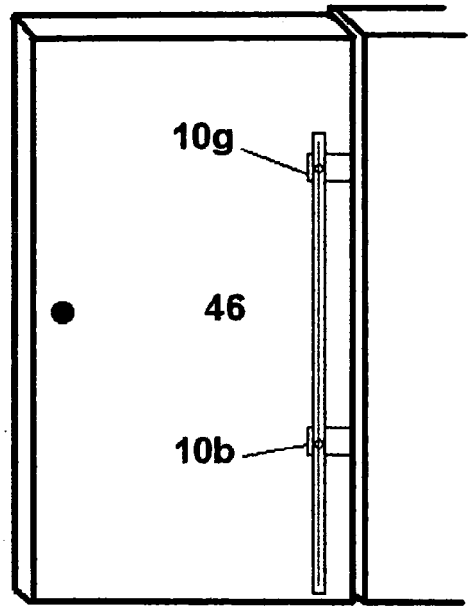
FIGS. 17 to 20 are similar to FIGS. 13 to 16 except for an additional vertical bracket.
Figure 18:
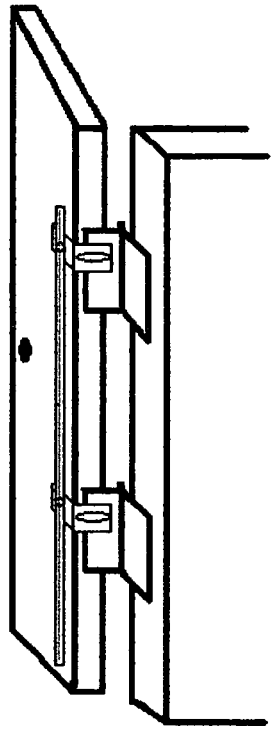
Figure 19:
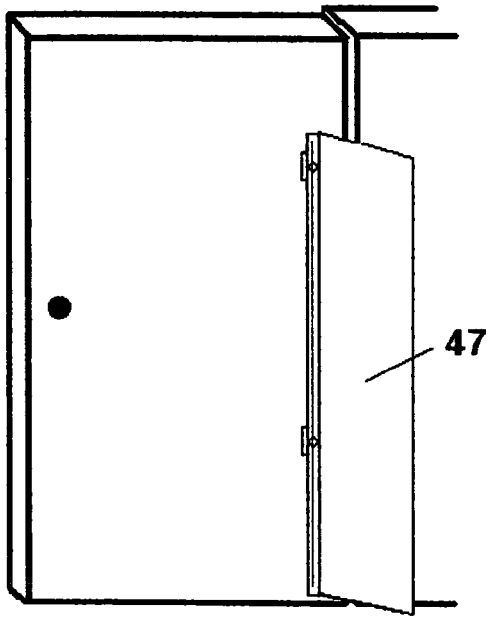
Figure 20:
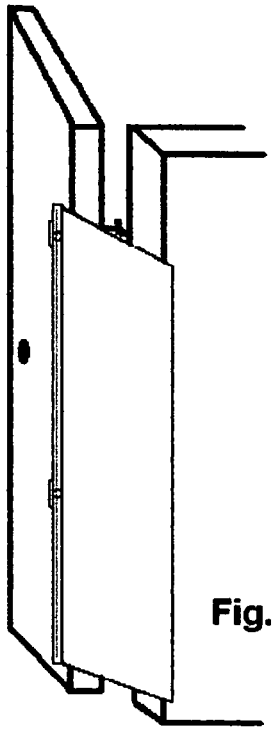

One such safety shield is illustrated in FIGS. 9 and 10 and is seen to include a first vertical rod 36 fixed to and supported on the fasteners on hinges 10*a* and 10*c*, and a second vertical rod 37 mounted on the fasteners on the hinges 10*b* and 10*d*. The rods 36 and 37 support a flexible shield 40 that prevents appendage access to the door jam area in both the opened and closed positions of the door.

A similar system is illustrated in FIGS. 13 to 16 except the door shield is supported on a single vertical support 41 fixed to brackets 10*e* and 10*f* supported on the wall or jam side 25. In this case shield 43 is supported solely on rod 41 eliminating the necessity for the other two brackets and supporting rods.

FIGS. 17 to 20 depict one sided applications similar to the embodiment shown in FIGS. 13 to 16 except that vertical support rod 46 is carried by brackets 10*g* and 10*h* carried by the door hinges as opposed to the jam hinges illustrated in FIGS. 13 to 16. Shield 47 is shown fixed to and carried by the vertical rod 46 in this embodiment.

The invention claimed is:

1. A door assembly and a door hinge mounted bracket assembly adapted to be mounted on an existing door hinge with door hinge screw fasteners, comprising: a generally planar door, at least two hinge assemblies each including two hinge plates, one being connected to the door and the other connected to an adjacent door jam, a generally "L" shaped body having a first generally planar surface adapted to engage one of the door hinge plates and having a face complementing the door hinge plate, a second generally planar surface generally orthogonally related to the first generally planar surface and extending outwardly over an outside portion of the door and the door jam, said first generally planar surface having apertures adapted to receive fasteners adapted to extend through the door hinge plate, a hinge screw fastener extending through the first generally planar surface and into the door hinge plate for supporting another element or assembly on the door hinge mounted bracket, and a fastener mounted on and projecting outwardly from the second surface for supporting a door hanging structure outside the door and the door jam.

2. A door hinge mounted bracket as defined in claim 1, wherein the generally "L" shaped bracket body has a first planar leg defining the first planar surface and an orthogonal second planar leg defining the second planar surface, a plurality of apertures in the first planar leg each adapted to receive and hold fasteners of different diameters, and a plurality of apertures in the second planar leg adapted to fasteners in different locations with respect to the door.

3. A door hinge mounted bracket as defined in claim 2, wherein the first planar leg has a first narrow rectangular slot therein and a second wider rectangular slot therein.

4. A door assembly and a door hinge mounted bracket assembly adapted to be mounted on an existing door hinge with door hinge screw fasteners, comprising; a generally planar door, at least two hinge assemblies each including two hinge plates, one being connected to the door and the other connected to an adjacent door jam, a first generally "L" shaped bracket adapted to be mounted on one door hinge plate including a first leg engaging the one door hinge and having a face complementing the door hinge, and a second leg adapted to receive a fastener for supporting a load element, said second leg extending outside the door and the door jam, a fastener on the second leg extending outwardly therefrom for a door hanging structure outside the door and the door jam, a second generally "L" shaped bracket adapted to be mounted on another door hinge plate including a first leg engaging the other door hinge plate and a second leg adapted to receive a fastener, said second leg of the second bracket having a fastener extending outwardly therefrom, and door hinge screw fasteners extending through the first and second bracket first legs and through their respective door hinge plates.

5. A door assembly and a door hinge mounted bracket assembly, comprising; a generally planar door, at least two hinge assemblies each including two hinge plates, one being connected to the door and the other connected to an adjacent door jam, a first generally "L" shaped bracket adapted to be mounted on one door hinge plate including a first leg engaging the one door hinge, and a second leg adapted to receive a fastener for supporting a load element, said second leg extending outside the door and the door jam, a fastener on the second leg extending outwardly therefrom for a door hanging structure outside the door and the door jam, a second generally "L" shaped bracket adapted to be mounted on another door hinge plate including a first leg engaging the other door hinge plate and a second leg adapted to receive a fastener, said second leg of the second bracket having a fastener extending outwardly therefrom, hinge screw fasteners extending through the first legs of the first and second brackets and into their respective existing door hinge plates, and a generally vertical support member extending between and supported on the second legs of both the first bracket and the second bracket including a door jam cover extending between the first and second brackets and supported thereon that covers the space between the door and the associated jam in both the opened and closed positions of the door.

6. A door hinge mounted bracket as defined in claim 4, wherein each of the first and second brackets has a first planar leg defining the first planar surface and an orthogonal second planar leg defining the second planar surface, a plurality of apertures in the first planar leg each adapted to receive and hold fasteners of different diameters, and a plurality of apertures in the second planar leg adapted to fasteners in different locations with respect to the door.

7. A door hinge mounted bracket as defined in claim 6, wherein the first planar leg has a first narrow rectangular slot therein and a second wider rectangular slot therein.

8. A method for mounting a door hinge bracket assembly to a door assembly including a door mounted to a door jam by at least two hinge assemblies each including a first hinge plate attached to the door by existing screw fasteners and a second hinge plate attached to the door jam by existing screw fasteners, where the bracket assembly is an "L" shaped bracket adapted to be mounted on one of the hinge assemblies having a first leg engageable with one of the hinge plates and having a face complementing that hinge plate, and a second leg having a mounting fastener extending outwardly therefrom, including the steps of: removing the existing screw fasteners from one of the hinge plates, placing the first leg of the "L" shaped bracket over and engaging the one hinge plate with the second leg extending outwardly over the outside of the door, and the door jam, screwing fasteners through the first leg and the one hinge plate into the door or the door jam to attach the bracket against the one hinge plate.

9. A door assembly and a door hinge mounted bracket assembly supported on both the door hinge plate and the door jam hinge plate, comprising; a generally planar door, at least two hinge assemblies each including two hinge plates, one being connected to the door and the other connected to an adjacent door jam, a first generally "L" shaped bracket adapted to be mounted on the door hinge plate having a first leg engaging the door hinge plate and a second leg adapted to receive a mounting fastener, said second leg extending outside the door and the door jam, a fastener on the second leg extending outwardly therefrom for a door hanging structure outside the door and the door jam, and a second generally "L" shaped bracket adapted to be mounted on the door jam hinge plate having a first leg engaging the door jam hinge plate, and a second leg adapted to receive a mounting fastener, said second leg of the second bracket having a fastener extending outwardly therefrom, and a supporting element extending between and supported on the second leg of the first and second brackets wherein the first and second brackets have a first planar leg defining the first planar surface and an orthogonal second planar leg defining the second planar surface, a plurality of apertures in the first planar leg each adapted to receive and hold fasteners of different diameters, and a plurality of apertures in the second planar leg adapted to fasteners in different locations with respect to the door, hinge screw fasteners extending through the first legs of the first and second brackets and into their respective existing door hinge plates, including a door jam cover extending between the first and second brackets and supported thereon that covers the space between the door and the associated jam in both the opened and closed positions of the door.

* * * * *